United States Patent [19]

Smith

[11] 4,226,601

[45] Oct. 7, 1980

[54] PROCESS FOR REDUCING SULFUR CONTAMINANT EMISSIONS FROM BURNING COAL OR LIGNITE THAT CONTAINS SULFUR

[75] Inventor: Robert H. Smith, Plano, Tex.

[73] Assignee: Atlantic Richfield Company, Los Angeles, Calif.

[21] Appl. No.: 756,195

[22] Filed: Jan. 3, 1977

[51] Int. Cl.[2] ..... C10L 9/10; C10L 5/00; C10L 5/12

[52] U.S. Cl. ..... 44/10 D; 44/1 G; 44/1 SR; 44/26; 110/347

[58] Field of Search ..... 44/1 G, 10 D, 16 R, 44/16 C, 1 R, 4, 26; 110/347

[56] References Cited

U.S. PATENT DOCUMENTS

| | | | |
|---|---|---|---|
| 44,817 | 10/1864 | Penniman | 44/1 R |
| 700,888 | 5/1902 | Basttistini | 44/4 |
| 1,007,153 | 10/1911 | Spurrier | 44/1 R |
| 1,856,495 | 5/1932 | McGlone | 44/4 |
| 3,026,189 | 3/1962 | Hall | 44/1 G |
| 3,640,016 | 2/1972 | Lee et al. | 44/1 R |
| 3,689,234 | 9/1972 | Onozawa | 44/16 A |
| 3,948,617 | 4/1976 | Whithorn | 44/4 |

FOREIGN PATENT DOCUMENTS

| | | | |
|---|---|---|---|
| 15266 | 3/1935 | Australia | 44/16 B |
| 995 | of 1881 | United Kingdom | 44/26 |
| 249170 | 3/1926 | United Kingdom | 44/26 |
| 535649 | 4/1941 | United Kingdom | 44/4 |

*Primary Examiner*—Carl F. Dees

*Attorney, Agent, or Firm*—Hubbard, Thurman, Turner, Tucker & Glaser

[57] ABSTRACT

A process for preparing a coal or lignite fuel that contains sulfur for combustion wherein reduced amounts of sulfur containing air contaminants are emitted from the combustion is disclosed. In the disclosed process, the coal or lignite that contains sulfur is first pulverized and is then mixed with a finely divided inorganic material. The inorganic material can be at least one of the oxides, hydroxides or carbonates of sodium, potassium, calcium or barium or it can be dolomite. By forming the mixture of coal or lignite and the inorganic material into briquettes or pellets, the mixture can be conveniently shipped, stored and used in conventional combustion equipment.

8 Claims, No Drawings

PROCESS FOR REDUCING SULFUR CONTAMINANT EMISSIONS FROM BURNING COAL OR LIGNITE THAT CONTAINS SULFUR

BACKGROUND OF THE INVENTION

This invention relates to a process for preparing a coal or lignite fuel, which contains sulfur, for combustion. In another aspect, this invention relates to a process for preparing coal or lignite, which contains sulfur, for combustion wherein the amounts of sulfur containing air contaminants normally emitted from such combustion are materially reduced. In another aspect, this invention relates to a method for preparing coal or lignite, which contains sulfur, for combustion with reduced emissions of contaminants whereby the prepared fuel can be shipped, stored and used in conventional equipment. In still another aspect, this invention relates to a method for burning coal or lignite, which contains sulfur, with reduced emissions of sulfur containing air contaminants wherein the coal or lignite is admixed with an inorganic material prior to burning the coal or lignite.

For many years, there has been a shift toward the use of petroleum materials, such as oil and natural gas, for satisfying our energy needs by burning such materials. Because of recent economic and political developments, there has been a drastic increase in the cost of energy sources, such as oil and natural gas. In view of the increased prices for oil and natural gas and becuase of real and potential shortages of these materials, various alternative sources of energy have been investigated.

It has long been known that vast resources of coal and lignite are available as alternative sources of energy in this country. Thus, a very simple solution to our increasing energy requirements would be to utilize coal and lignite as an energy source. Recently, many utility companies, industrial facilities and the like, have either partially or totally changed their sources of energy to coal or lignite because of the availability and cost of such alternate energy sources.

Just as interest has shifted to alternative sources for energy, there has been an increased emphasis placed on "clean burning" fuels. The term, "clean burning" is a term that broadly includes the combustion of various fuels without the production of noxious and harmful combustion products such as sulfur oxides and the like. In fact, there has been a rash of rather strict legislative and regulatory restrictions or limits placed on the amount of contaminants such as sulfur oxides that can be emitted into the atmosphere. It is, of course, well known in the art that energy sources such as coal, lignite, oil and the like, that contain sulfur will produce large quantities of sulfur oxide contaminants.

Unfortunately, much of the coal and lignite found in this country in commercial quantities do contain sulfur in varying quantities. When such sulfur containing coal and lignite materials are burned, sulfur oxides are produced and are emitted into the atmosphere, unless very costly and elaborate measures are undertaken to remove the sulfur oxides from the flue gases coming from the combustion equipment.

In an effort to satisfy various legislative and regulatory restrictions on the amount of sulfur oxides that are emitted into the atmosphere by burning sulfur containing coal and lignite, many types of methods and apparatus have been utilized to minimize such emissions. Almost universally, such methods and apparatus have added to the cost of the conversion of the sulfur-containing coal or lignite into useful energy. In fact, in order to meet rigid requirements pertaining to emissions of sulfur oxides, the cost of various methods and apparatus for reducing sulfur oxide emissions such as by use of complicated and costly scrubbers, precipitators and the like, have virtually made some coal and lignite supplies unattractive for the production of needed energy.

In view of the foregoing, it is highly desirable that inexpensive and practical methods be developed for converting sulfur-containing coal and lignite into useful energy with reduced emissions of sulfur containing air contaminants.

SUMMARY OF THE INVENTION

Accordingly, it is an object of this invention to provide an improved process for preparing a sulfur-containing coal or lignite material for combustion. It is another object of this invention to provide an improved process for preparing sulfur-containing coal or lignite for combustion in conventional equipment with reduced sulfur-oxide emissions. It is yet another object of this invention to prepare coal or lignite, which contains sulfur, for combustion with reduced emissions of contaminants whereby the prepared fuel can be shipped, stored and used in conventional equipment. It is still a further object of this invention to provide a process wherein a sulfur-containing coal or lignite is burned with reduced emissions of sulfur oxide combustion products without utilizing expensive pollution control equipment.

Other aspects, objects and advantages of this invention will be apparent to those skilled in the art from the following disclosure and appended claims.

It has been found that sulfur-containing coal or lignite can be prepared for combustion in conventional combustion equipment with reduced sulfur oxide air emissions. In the instant invention, the sulfur-containing coal or lignite is reduced in size to form a finely divided coal or lignite. The thus pulverized sulfur-containing coal or lignite is then admixed with a finely divided inorganic material. The resulting admixture of coal or lignite and the inorganic material can thereafter be subjected to a combustion process in conventional combustion equipment with reduced emissions of sulfur oxide combustion products. Preferably, the resulting admixture will be formed into pellets, briquettes, or other large particles for subsequent shipping, storage and/or combustion in conventional equipment. The inorganic material that is admixed with the finely divided or pulverized sulfur-containing coal or lignite can be at least one material selected from: an oxide of sodium, potassium, calcium or barium; a hydroxide of sodium, potassium, calcium or barium; a carbonate of sodium, potassium, calcium or barium; or dolomite.

DESCRIPTION OF PREFERRED EMBODIMENTS

In the preferred embodiments of this invention, a sulfur containing coal or lignite material is intimately admixed with an inorganic material, as hereinafter defined. It has been found that the best results in reducing the amount of sulfur containing air cntaminants that are emitted upon burning sulfur containing coal or lignite are obtained when the coal or lignite is finely divided and the inorganic material is thoroughly dispersed through the finely divided coal or lignite material.

Therefore, while some reduction in the amount of sulfur containing air contaminants will be achieved by mixing the specified inorganic materials with the coal or lignite when the coal or lignite has a relatively large particle size, it is desirable to reduce the particle size of the coal or lignite prior to the combustion process and to intimately admix the small particle size coal or lignite with the inorganic material prior to such combustion. Of course, it will be realized that most coal or lignite is mined with mechanical equipment and it is often recovered from the mine site in large, irregular particle sizes. Thus, in a preferred embodiment of this invention, it is desirable to reduce the particle size of the coal or lignite to as small a particle size as is practical. It has been found that as the particle size of the coal or lignite decreases, the efficiency of the instant invention in reducing the emissions of sulfur containing air contaminants increases, at a given level of the inorganic materials. Thus, there is no minimum size restriction placed on the particle size of the coal or lignite as it is admixed with the inorganic material to form the mixture for later burning. Preferably, however, the particle size of the coal or lignite will be less than about one-tenth inch in diameter in order to achieve the desired reductions in sulfur containing emissions when the coal or lignite is burned. More preferably, the coal or lignite will have a particle size in the 48 mesh range or smaller (Tyler screen mesh sizes).

Any known method and equipment for reducing the size of the coal or lignite can be utilized such as conventional grinding and crushing in crushers, hammer mills and the like. As used throughout this specification, the term "pulverized" coal or lignite shall mean coal or lignite that has an average particle size of less than about one-tenth inch in diameter.

The inorganic material that is used to admix with the pulverized coal or lignite can be at least one material selected from the oxides of sodium, potassium, calcium or barium; the hydroxides of sodium, potassium, calcium or barium; the carbonates of sodium, potassium, calcium or barium; and dolomite. Thus, suitable examples of inorganic materials that can be utilized to admix with the pulverized sulfur containing coal or lignite include sodium oxide, potassium oxide, calcium oxide, barium oxide, sodium hydroxide, potassium hydroxide, calcium hydroxide, barium hydroxide, sodium carbonate, potassium carbonate, sodium bicarbonate, calcium carbonate, barium carbonate and dolomite ($Ca\ Mg\ (CO_3)_2$). Mixtures of the foregoing materials can be and are often used as the inorganic material that is admixed with the sulfur containing coal or lignite. The foregoing inorganic materials can be in the form of naturally occurring minerals or in the form of relatively pure compounds. However, it will be appreciated that since large quantities of such inorganic materials will be utilized in the process of this invention, inexpensive sources of such inorganic materials will be very attractive. Therefore, the above-mentioned inorganic materials can be added to the pulverized sulfur containing coal or lignite with other impurities, so long as such impurities, themselves, do not form noxious air contaminants when they are subjected to the combustion conditions. One particularly preferred source of the inorganic materials is naturally occurring limestone. Other preferred sources of the inorganic materials include lime and industrial waste materials that contain any of the foregoing components in appreciable quantities. Aqueous solutions or slurries of such materials, which are normally treated as waste products, are very attractive as sources of inorganic materials. When the inorganic materials are added to the coal or lignite in an aqueous or slurry form, substantially all of the solvent or liquid carrier should be evaporated or otherwise removed from the admixture to leave a substantially dry admixture for burning.

Since the present invention provides for the intimate admixing of the inorganic materials with the sulfur containing coal or lignite, it will, of course, be appreciated that the inorganic materials be in a finely divided form. Therefore, when such inorganic materials are added to the pulverized sulfur containing coal or lignite in a solid form, it will be necessary that they, too, be pulverized to a finely divided state. The inorganic materials should have a particle size in the general range of the particle sizes mentioned above for the sulfur containing coal or lignite. It has been found that the most efficient reductions in sulfur containing air emissions are achieved when the inorganic materials are in a very finely divided state. Thus, it is preferred that the inorganic materials have a particle size of less than about forty-eight mesh (Tyler screen mesh). Particle sizes smaller than the 48 mesh size are the most preferred. In instances where the inorganic material can be dissolved in a suitable solvent, such as an aqueous solution of sodium hydroxide and the like, improved efficiencies may be obtained.

Any suitable means for reducing the particle size of the inorganic materials can be utilized, such as by grinding, crushing and the like.

The pulverized coal or lignite and the finely divided inorganic materials can be intimately admixed together by any suitable means. It is important, however, than an intimate admixture be formed whereby the inorganic material is completely dispersed throughout a mass of the pulverized coal or lignite. Therefore, tumblers, ribbon mills and the like can be utilized to form the intimate admixture. As previously mentioned, a solution of the inorganic material is very beneficial for thoroughly dispersing the inorganic material throughout the mesh of the pulverized coal or lignite. In such instances, the solution of the inorganic material can be conveniently sprayed on the surface of the coal or lignite and the solvent can be removed by evaporation. Another suitable method for applying the inorganic material to the coal or lignite is by forming a slurry of the finely divided inorganic material in a suitable carrier such as water and the like, and thereafter, spraying the slurry on the surface of the coal or lignite while tumbling or shaking the coal to insure a complete dispersion of the slurry throughout the mesh of the coal or lignite.

It will be appreciated that while the foregoing discussion has been directed to first pulverizing the coal or lignite and thereafter adding the finely divided inorganic material, in some instances, it may be desirable to add the finely divided inorganic material to the coal or lignite prior to the size reduction step wherein the coal or lignite is reduced in size. Thus, in such instances, it may be desirable to add the finely divided inorganic materials to the rather large particle size coal or lignite and thereafter grind or crush the coal or lignite. In such instances, the grinding or crushing will assist in a thorough dispersion of the inorganic material throughout the coal or lignite, as well as further reducing the particle size of the inorganic material in the final admixture. It will also be appreciated that, in some instances, it may be desirable to grind or crush the coal or lignite along with rather large particle size inorganic materials. In such instances, the coal or lignite and the large particle size inorganic materials, such as pieces of limestone, dolomite, and the like, can be subjected to a crushing and grinding step without the necessity of first grinding or crushing either of the components separately.

Many problems may be experienced in the handling, shipping, storage and burning of the admixture of finely divided coal or lignite and the inorganic material. For example, the finely divided solids are prone to blow and be dispersed in even slight air currents. Additionally, there is also a danger of explosions when finely divided coal or lignite is handled, stored or shipped. Admixtures of finely divided coal or lignite and the inorganic materials may also tend to separate due to differing densities when they are handled, shipped or stored, especially under conditions where such admixtures are subjected to vibrations. Therefore, in the preferred embodiments of this invention, the admixture will be formed into pellets, briquettes or other larger particles to allow the admixture to be safely and efficiently handled, shipped, stored and used in conventional equipment. The admixture of inorganic material with the coal or lignite can be agglomerated or pelletized to produce a product which can be safely handled, shipped, or stored, without appreciable dust loss and can be supplied to conventional combustion apparatus with conventional equipment normally used for handling and stoking coal or lignite in large pieces.

Any suitable method for forming the pellets, briquettes or larger pieces of the admixture can be utilized. In forming the pellets, briquettes and other larger pieces, it has been found particularly desirable to utilize binders or adhesives such as small amounts of coal tar pitch, petroleum pitch and residue materials, such as vacuum residium, or other adhesive material, such as lignin sulphates and the like, that are obtained as by-products in the paper industry. By mixing or coating the small finely divided particles of coal or lignite and inorganic material with a suitable adhesive material, such as those mentioned above and thereafter, submitting the mixture to an agglomerating, prilling, or a compressing process, larger particles, prills, pellets or briquettes, can be formed. Such larger discrete particles, prills, pellets, briquettes, and the like, can be shipped, handled, stored and used without the disadvantages normally associated with powdered or pulverized coal or lignite. By utilizing the preferred technique of forming the safe and convenient pellets, briquettes or larger pieces of the admixture, the sulfur containing coal or lignite can be burned in conventional combustion equipment, such as stoker type furnaces with greatly reduced emissions of sulfur contaminants.

In one of the more preferred embodiments of this invention, coal or lignite is mined and pulverized at or near the mine site and mixed with the inorganic material. Thereafter, the admixture is preferably formed into the preferred pellets, briquettes and the like, and shipped to intermediate storage or to the user.

The amount of inorganic material that will be added to and admixed with the pulverized coal or lignite will depend on the amount of sulfur that is contained in the raw coal or lignite. Normally, the inorganic material will be added to the coal or lignite in an amount such that at least a stoichiometric amount of the inorganic material is present with respect to the amount of sulfur in the coal or lignite. The stoichiometric amounts of the inorganic materials are calculated on the basis of two-pound atoms of the sodium or potassium compounds per one-pound atom of sulfur contained within the coal or lignite and one-pound atom of the barium or calcium compounds, including dolomite, per pound atom of the sulfur contained in the coal or lignite. Expressed in another way, the inorganic materials will be added to the sulfur containing coal or lignite in such amounts as to provide an atomic ratio of sodium or potassium to sulfur of at least 2:1 and an atomic ratio of calcium or barium to sulfur of at least 1:1. Thus, in the preferred embodiment of this invention, the calcium to sulfur atom ratio should be at least about 1:1, the barium to sulfur atom ratio should be at least about 1:1; the potassium to sulfur atomic ratio should be at least about 2:1; and the sodium to sulfur atomic ratio should be at least about 2:1. While there will be some reduction in the amount of sulfur containing contaminants that are emitted from the combustion chamber when the inorganic materials are added in quantities less than those stated above, the optimum sulfur reduction will be obtained when the above-mentioned mol ratios are at least those as stated.

Since the inorganic materials that are added to the sulfur containing coal or lignite are, in fact, ash-forming materials, it will be appreciated that it is undesirable to add large excesses of the inorganic materials. From a practical standpoint, the inorganic materials will be added in amounts such that the final admixture will have an atomic ratio of calcium to sulfur or barium to sulfur of from about 1:1 to about 5:1 and an atomic ratio of potassium to sulfur or sodium to sulfur of from about 2:1 to about 10:1 to achieve significant reductions in the amount of sulfur containing emissions upon combustion, yet, to minimize the amount of undesirable ash formed upon combustion of the coal or lignite. Since most coal and lignite will contain less than five weight percent sulfur, it will be appreciated that the final admixture of the sulfur or lignite with the inorganic material will not contain great amounts of the inorganic ash-forming material.

It has been found that admixtures of coal or lignite with the calcium based inorganic materials, such as calcium oxide, hydroxide, carbonates and dolomite, reduce the amount of sulfur containing contaminants that are emitted in the flue gas from the combustion chamber when the combustion is carried out at a bed temperature of less than about 2200° F. when the combustion is at or near atmospheric pressure. Therefore, in the preferred embodiments of this invention, a substantial amount of the combustion process is carried out at a bed temperature of less than about 2200° F. when the combustion is at or near atmospheric pressure when the inorganic material is a compound of calcium. When the combustion process is carried out at prolonged combustion bed temperatures above about 2200° F. at or near atmospheric pressure, there will still be some reduction of sulfur containing emissions in the flue gas but the efficiency of such reduction will decline. By increasing the combustion pressure up to about 200 psig, the combustion temperature can also be increased up to about 2500° F. and the benefits of the invention can still be achieved with calcium containing inorganic materials.

When admixtures of coal or lignite with barium containing inorganic materials are subjected to combustion, the combustion bed temperature should be less than about 2600° F. in order to achieve maximum reduction of sulfur containing emissions, when the combustion is carried out at or near atmospheric pressure. Thus, in one of the preferred embodiments of this invention, the incorporation of barium containing inorganic material into a sulfur containing coal or lignite admixture, will produce a fuel that emits significantly reduced amounts of sulfur containing contaminants upon combustion when the temperature of combustion bed is maintained at less than about 2600° F. Prolonged combustion bed temperatures above about 2600° F. will normally result in some decrease in the efficiency of reducing sulfur emissions. It has been found that by increasing the pressure within the combustion chamber up to about 200 psig, the combustion bed temperature can also be increased up to about 2900° F. with the barium containing inorganic materials substantially reducing the amounts of sulfur contaminants being emitted in the flue gas.

When sodium or potassium containing inorganic materials are utilized in accordance with this invention, it has been found that the maximum reduction of sulfur contaminants in the flue gas is achieved when the combustion bed temperature is at less than about 3000° F. Therefore, in the preferred embodiment of this invention, when the combustion pressure is at or about atmospheric pressure, and when sodium or potassium containing inorganic materials are utilized, the combustion bed temperature should be less than about 3000° F. By increasing the pressure in the combustion chamber to about 200 psig, the beneficial results of this invention can be achieved with sodium or potassium inorganic materials with combustion bed temperatures of up to about 3300° F. While the foregoing preferred bed temperatures of combustion provide for maximum reduction of sulfur contaminant emissions, there will still be some reduction of sulfur contaminants when combustion bed temperatures exceed such preferred temperatures, but there may be some slight reduction in the efficiency of reducing the sulfur contaminant emissions. It, of course, will be appreciated that the foregoing temperatures of the combustion beds are temperatures normally experienced in combustion equipment such as stoker boilers and the like.

The following examples are presented to illustrate embodiments of the present invention. The examples are given for illustrative purposes only and are not intended to limit the scope of the invention.

EXAMPLE ONE

A series of runs was carried out to show the effectiveness of calcium oxide and calcium carbonate in reducing the emissions of sulfur containing contaminants from a combustion zone wherein a sulfur containing coal was burned. In this series of runs, Illinois No. 6 coal was ground to a particle size of less than sixty mesh. In each run, from about four to five grams of coal were weighed and placed in a ceramic boat and then placed in a one-inch diameter combustion tube. The combustion tube was heated in an electric furnace at 1600° F. Air was passed across the ceramic boat in the combustion tube and the combustion gases were bubbled through a scrubber containing a five percent solution of sodium hydroxide. Following complete combustion of the coal sample, the scrubber solution was analyzed for sulphates by first neutralizing the solution and adding barium chloride. The barium sulphate, resulting from the amount of sulfur absorbed from the combustion gases was analyzed to determine the amount of sulfur that was absorbed in the scrubber solution. The barium sulphate was determined by a light scattering technique. In the first run, only Illinois No. 6 coal was burned. In runs 2, 3, and 4, calcium oxide and calcium carbonate were ground to a particle size of less than sixty mesh and blended with the coal prior to the combustion to produce an intimate admixture. The results of the tests are reported below in Table I:

TABLE I

| Run | Combustion Sample (WT.%) | Sulfur Collected In Scrubber as a Weight % of Feed Coal |
|---|---|---|
| 1 | 100% coal | 2.35 |
| 2 | 95.2% coal & 4.8% CaO | 0.44 |
| 3 | 80% coal and 20% CaO | 0.0005 |
| 4 | 90% coal and 10% $CaCO_3$ | 1.01 |

The foregoing data illustrate the efficiency of calcium oxide and calcium carbonate for reducing the emissions of sulfur containing contaminants when the sulfur containing coal is burned. It should be noted that when only the raw coal was burned virtually all of the sulfur contained in the original coal sample was emitted as a sulfur containing contaminant in the flue gas. When less than five weight percent of calcium oxide was blended with the coal, less than 19% of the sulfur in the coal sample was emitted as a sulfur containing contaminant, as shown in Run 2. When the calcium oxide was increased to twenty weight percent, the sulfur containing contaminants emitted were reduced to a negligible level. Likewise, when only ten weight percent of calcium carbonate was added to the coal and the coal was burned, the amount of sulfur containing contaminants emitted was reduced by over 57%.

EXAMPLE TWO

A series of runs was carried out wherein coal was burned under self-sustained combustion conditions in a stove that was lined with insulation to lower heat losses. Air was pulled through the stove by convection induced draft through the stack of the stove. Combustion gases or flue gases were sampled from the stack and were taken through a collection train that consisted of a glass wool dust collector, a gas sample bomb and a sodium hydroxide scrubber. The flue gas samples were pulled through the scrubbing system at a rate of one liter per minute by a vacuum pump. Gas was sampled for thirty minutes starting immediately after combustion was established. Combustion was started by an electrical heating coil placed in the coal. Once burning was started, the coil was removed.

The coal was prepared for the combustion test by grinding Illinois No. 6 coal to a particle size of less than sixty mesh. Calcium oxide and calcium carbonate were added to some of the samples in the form of finely ground calcium oxide of calcium carbonate having a particle size of less than sixty mesh. Upon thoroughly admixing the inorganic materials with the pulverized coal, the ground coal and the inorganic materials added, if any, were pelletized into one and one-fourth inch diameter by one-inch thick cylindrical pellets. In each of the tests, four pounds of the coal and added inorganic material, if any, were burned in each run.

Table II sets forth the results observed in the series of tests:

TABLE II

| Run | Inorganic Material | LB Inorganic Material Per LB Coal | Sulfur Emitted Calcium To Sulfur Atomic Ratio | In Flue Gas (Grams Per Liter $X10^4$) |
|---|---|---|---|---|
| 1 | NONE | 0 | 0 | 12.08 |

TABLE II-continued

| Run | Inorganic Material | LB Inorganic Material Per LB Coal | Sulfur Emitted Calcium To Sulfur Atomic Ratio | In Flue Gas (Grams Per Liter X10$^4$) |
|---|---|---|---|---|
| 2 | CaO | 0.1 | 2.19 | 0.829 |
| 3 | CaO | 0.05 | 1.09 | 2.77 |
| 4 | $CaCO_3$ | 0.0813 | 1.00 | 3.23 |
| 5 | $CaCO_3$ | 0.1626 | 2.00 | 3.40 |

The foregoing illustrate the efficiency of the inorganic materials for reducing sulfur containing emissions in the flue gas when coal is burned under self-sustained conditions.

Various changes and modifications may be made in the foregoing disclosure without departing from the spirit and scope of this invention.

I claim:

1. In a process wherein a sulfur containing coal or lignite is burned, the improvement which comprises:

(a) admixing pulverized coal or lignite with at least one inorganic material selected from the group consisting of (i) an oxide of sodium, potassium, calcium or barium; (ii) a hydroxide of sodium, potassium, calcium or barium; (iii) a carbonate of sodium, potassium, calcium or barium; and (iv) dolomite; and (b) thereafter burning the admixture of said pulverized coal or lignite and said inorganic material in conventional combustion equipment at a combustion bed temperature of less than about 3000° F. when said inorganic material is a sodium or potassium compound, less than about 2200° F. when said inorganic material is a calcium compound and less than about 2600° F. when said inorganic material is a barium compound.

2. The process of claim 1 wherein said inorganic material is finely divided and is mixed with said coal or lignite to form an intimate admixture.

3. The process of claim 2 wherein said intimate admixture is formed into pellets or briquettes prior to said burning.

4. The process of claim 3 wherein a binder material is incorporated into said admixture prior to forming said pellets or briquettes.

5. The process of claim 2 wherein said inorganic material is limestone.

6. The process of claim 5 wherein said limestone is admixed with said pulverized coal or lignite by forming a slurry of finely divided limestone and thereafter applying said slurry to said coal or lignite.

7. The process of claim 2 wherein said inorganic material is added to said coal or lignite in an amount such that the resulting admixture has a sodium or potassium to sulfur atomic ratio of at least about 2:1.

8. The process of claim 2 wherein said inorganic material is added to said coal or lignite in an amount such that the resulting admixture has a calcium or barium to sulfur atomic ratio of at least about 1:1.

* * * * *

Notice of Adverse Decision in Interference

In Interference No. 100,845, involving Patent No. 4,226,601, R. H. Smith, PROCESS FOR REDUCING SULFUR CONTAMINANT EMISSIONS FROM BURNING COAL OR LIGNITE THAT CONTAINS SULFUR, final judgment adverse to the patentee, was rendered July 22, 1983, as to claims 1–4, 6 and 8.

[*Official Gazette November 15, 1983.*]